US010589954B2

(12) United States Patent
Nakajima

(10) Patent No.: US 10,589,954 B2
(45) Date of Patent: Mar. 17, 2020

(54) PAPER SHEET RECYCLING AND PRINTING APPARATUS, PRINTING APPARATUS, AND PAPER SHEET RECYCLING APPARATUS

(71) Applicant: SEIKO EPSON CORPORATION, Tokyo (JP)

(72) Inventor: Yasumasa Nakajima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/313,918

(22) PCT Filed: Jun. 2, 2017

(86) PCT No.: PCT/JP2017/020662
§ 371 (c)(1),
(2) Date: Dec. 28, 2018

(87) PCT Pub. No.: WO2018/003404
PCT Pub. Date: Jan. 4, 2018

(65) Prior Publication Data

US 2019/0225447 A1 Jul. 25, 2019

(30) Foreign Application Priority Data

Jun. 30, 2016 (JP) ..... 2016-129816

(51) Int. Cl.
*B65H 29/58* (2006.01)
*B41J 29/38* (2006.01)
(Continued)

(52) U.S. Cl.
CPC ..... *B65H 29/58* (2013.01); *B41J 3/44* (2013.01); *B41J 11/485* (2013.01); *B41J 13/103* (2013.01);
(Continued)

(58) Field of Classification Search
CPC . B65H 29/58; B65H 31/24; B65H 3/44; B41J 29/38; B41J 3/44; B41J 13/103; B41J 11/485; G03G 21/00
(Continued)

(56) References Cited

U.S. PATENT DOCUMENTS 5,463,447 A 10/1995 Kurotori et al.
5,678,157 A 10/1997 Yoshida et al.
(Continued)

FOREIGN PATENT DOCUMENTS

JP 06-089068 A 3/1994
JP 07-175384 A 7/1995
(Continued)

*Primary Examiner* — Allen H Nguyen
(74) *Attorney, Agent, or Firm* — Global IP Counselors, LLP

(57) ABSTRACT

A paper sheet recycling and printing apparatus includes a paper sheet recycling section which manufactures a recycled paper sheet; a printing section which prints recording information on a recording target medium including the recycled paper sheet; a plurality of recycled paper sheet storage sections including a first recycled paper sheet storage section and a second recycled paper sheet storage section in which the recycled paper sheet is stored; a recycled paper sheet supply section which supplies the recycled paper sheet from the paper sheet recycling section to the recycled paper sheet storage section; and a transport section which transports the recording target medium to the printing section. The transport section transports the recycled paper sheet stored in the first recycled paper sheet storage section to the printing section, and the recycled paper sheet supply section supplies the recycled paper sheet to the second recycled paper sheet storage section.

11 Claims, 8 Drawing Sheets

(51) Int. Cl.

| | |
|---|---|
| ***B65H 31/24*** | (2006.01) |
| ***B65H 3/44*** | (2006.01) |
| ***G03G 21/00*** | (2006.01) |
| ***B41J 3/44*** | (2006.01) |
| ***B41J 13/10*** | (2006.01) |
| ***B41J 11/48*** | (2006.01) |

(52) U.S. Cl.
CPC ..... *B41J 29/38* (2013.01); *B65H 3/44* (2013.01); *B65H 31/24* (2013.01); *G03G 21/00* (2013.01)

(58) Field of Classification Search
USPC ..... 358/1.1
See application file for complete search history.

(56) References Cited

U.S. PATENT DOCUMENTS 6,236,831 B1 * 5/2001 Mei ..... B41J 29/36 15/102
8,081,347 B2 * 12/2011 Tamada ..... G03G 15/04018 358/1.1
8,243,292 B2 * 8/2012 Qian ..... B41J 11/009 358/1.1
2004/0252314 A1 * 12/2004 Takahashi ..... G06F 3/1204 358/1.1
2009/0103147 A1 * 4/2009 Murakami ..... G03G 21/1647 358/498
2012/0038732 A1 * 2/2012 Iguchi ..... G03G 21/00 347/179
2013/0278664 A1 * 10/2013 Arakane ..... B41J 23/04 347/16
2015/0064638 A1 * 3/2015 Sugiyama ..... B41M 7/0009 432/1
2016/0168794 A1 6/2016 Tsujino

FOREIGN PATENT DOCUMENTS

| | | | |
|---|---|---|---|
| JP | 07-245668 | A | 9/1995 |
| JP | 10-171318 | A | 6/1998 |
| JP | 2008-033034 | A | 2/2008 |
| JP | 2012-067424 | A | 4/2012 |
| JP | 2016-113721 | A | 6/2016 |

* cited by examiner

PAPER SHEET RECYCLING AND PRINTING APPARATUS, PRINTING APPARATUS, AND PAPER SHEET RECYCLING APPARATUS

CROSS-REFERENCE TO RELATED APPLICATIONS

This application is a U.S. National stage application of International Patent Application No. PCT/JP2017/020662, filed on Jun. 2, 2017, which claims priority under 35 U.S.C. § 119(a) to Japanese Patent Application No. 2016-129816, filed in Japan on Jun. 30, 2016. The entire disclosure of Japanese Patent Application No. 2016-129816 is hereby incorporated herein by reference.

TECHNICAL FIELD

The present invention relates to a paper sheet recycling and printing apparatus, a printing apparatus, and a paper sheet recycling apparatus.

BACKGROUND ART

Paper recycling has been widely generalized from the viewpoint of resource utilization, but in the past, industrial manufacturing of a recycled paper sheet from an accumulated waste paper sheet was employed. In recent years, however, a technique and apparatus for forming a document printed and discarded in a business office into a recycled paper sheet in a business office and inserting the recycled paper sheet as a printing paper sheet to a printing machine have been disclosed (refer to Japanese Unexamined Patent Application Publication Nos. 7-175384, 10-171318, and 2008-33034).

Each of the inventions disclosed in Japanese Unexamined Patent Application Publication Nos. 7-175384, 10-171318, and 2008-33034 is a combined apparatus that supplies a recycled paper sheet directly to a printing apparatus from an apparatus for recycling a paper sheet on which the printing is finished, that is, a so-called waste paper sheet, and recycling of the waste paper sheet and printing onto the recycled paper sheet can be continuously performed.

However, the method of recycling the waste paper sheet in the apparatuses disclosed in Japanese Unexamined Patent Application Publication Nos. 7-75384, 10-171318, and 2008-33034 forms a recording target medium on which new printing is possible by physically removing a recording medium which is called a toner that adheres to a surface of the recording target medium (paper sheet). Contrary to this, a small-sized apparatus has been suggested in which the waste paper sheet is pulverized to a fibrous form and a new paper sheet can be formed, but in this case, it is possible to stabilize the quality of the recycled paper sheet and obtain high productivity by continuously inserting the waste paper sheet to be inserted into a recycling step and by continuously operating the apparatus.

In other words, by the continuous operation of the above-described apparatus, the recycled paper sheets are continuously supplied from the recycling apparatus to a paper sheet tray and the like of the printing apparatus. Meanwhile, since the printing apparatuses are normally used intermittently, when the recycled paper sheets stored in the paper sheet tray are held by paper sheet pickup means for printing, substantially at the same time, there may be a case where the recycled paper sheet is supplied from the recycling apparatus to the paper sheet tray. In this case, there is a concern of occurrence of jamming caused by paper sheet complication of two paper sheets.

This is because an abnormal state is determined in the printing apparatus, the printing apparatus is stopped, and the work efficiency remarkably deteriorates. Here, a paper sheet recycling and printing apparatus which prevents complication with the recycled paper sheet which is supplied to the printing apparatus and is already stored therein, that is, so-called occurrence of jamming, while continuously operating the paper sheet recycling apparatus and storing the recycled paper sheet.

SUMMARY

The present invention has been made to solve at least a part of the above-described problems, and it is possible to realize the following aspects or application examples.

Application Example 1

According to this application example, there is provided a paper sheet recycling and printing apparatus including: a paper sheet recycling section which manufactures a recycled paper sheet; a printing section which prints recording information on a recording target medium including the recycled paper sheet; a plurality of recycled paper sheet storage sections including a first recycled paper sheet storage section and a second recycled paper sheet storage section in which the recycled paper sheet is stored; a recycled paper sheet supply section which supplies the recycled paper sheet from the paper sheet recycling section to the recycled paper sheet storage section; and a transport section which transports the recording target medium to the printing section, in which the transport section transports the recycled paper sheet stored in the first recycled paper sheet storage section to the printing section, and in which the recycled paper sheet supply section supplies the recycled paper sheet to the second recycled paper sheet storage section.

The paper sheet recycling and printing apparatus of this application example is an apparatus system which can directly transport the recycled paper sheet formed by the paper sheet recycling section to the printing section and obtain a printed material. In addition, according to the paper sheet recycling and printing apparatus of this application example, the plurality of recycled paper sheet storage sections in which the recycled paper sheet formed by the paper sheet recycling section can be stored, are provided. Accordingly, it becomes possible to store many recycled paper sheets, and it is possible to lengthen the continuous operation time of the paper sheet recycling section, and to provide a recycled paper sheet having a stable quality.

In addition, according to the paper sheet recycling and printing apparatus of this application example, from the plurality of recycled paper sheet storage sections in which the recycled paper sheet is stored, one recycled paper sheet storage section selected by supplying the recycled paper sheet to the printing section is designated as the first recycled paper sheet storage section, and one recycled paper sheet storage section selected by storing the recycled paper sheet formed and supplied from the paper sheet recycling section is designated as the second recycled paper sheet storage section. Accordingly, by designating the first recycled paper sheet storage section and the second recycled paper sheet storage section as recycled paper sheet storage sections different from each other from the plurality of recycled paper sheet storage sections, when taking out the recycled paper sheet from the first recycled paper sheet storage section, the recycled paper sheet is not supplied inadvertently from the paper sheet recycling section. In other words, it is possible to avoid the occurrence of jamming caused by the paper sheet complication in the first recycled paper sheet storage section.

Application Example 2

In the above-described application example, the recycled paper sheet supply section includes supply switching means that is capable of transporting the recycled paper sheet to one of the plurality of recycled paper sheet storage sections.

According to the above-described application example, it is possible to select one recycled paper sheet storage section in which the recycled paper sheet can be stored among the plurality of recycled paper sheet storage sections, and to supply the recycled paper sheet to the recycled paper sheet storage section selected by the supply switching means of the recycled paper sheet supply section and to store the recycled paper sheet therein. In other words, it is possible to supply the recycled paper sheet from the plurality of recycled paper sheet storage sections in which the recycled paper sheet formed by the paper sheet recycling section is stored to the recycled paper sheet storage section selected by the switching means of the recycled paper sheet supply section. Accordingly, it becomes possible to supply the recycled paper sheet to the selected recycled paper sheet storage section without stopping the paper sheet recycling section, and it is possible to lengthen the continuous operation time of the paper sheet recycling section, and to provide a recycled paper sheet having a stable quality.

Application Example 3

In the above-described application example, the supply switching means switches supply of the recycled paper sheet from the recycled paper sheet supply section to one recycled paper sheet storage section in which there is no recycled paper sheet among the plurality of recycled paper sheet storage sections as the second recycled paper sheet storage section.

According to the above-described application example, when a new second recycled paper sheet storage section is selected from the recycled paper sheet storage sections except for the first recycled paper sheet storage section which supplies the recycled paper sheet to the printing section, and the recycled paper sheet is taken out from the first recycled paper sheet storage section, there is no case where the recycled paper sheet is inadvertently supplied from the paper sheet recycling section. In other words, it is possible to avoid the occurrence of jamming caused by the paper sheet complication in the first recycled paper sheet storage section.

Application Example 4

In the above-described application example, the transport section includes transport switching means for setting one of the plurality of the recycled paper sheet storage sections as the first recycled paper sheet storage section and for transporting the recycled paper sheet from the set first recycled paper sheet storage section.

According to the above-described application example, when a new first recycled paper sheet storage section is set from the recycled paper sheet storage sections except for the second recycled paper sheet storage section to which the recycled paper sheet is supplied from the paper sheet recycling section, and the recycled paper sheet is taken out from the first recycled paper sheet storage section, there is no case where the recycled paper sheet is inadvertently supplied from the paper sheet recycling section. In other words, it is possible to avoid the occurrence of jamming caused by the paper sheet complication in the first recycled paper sheet storage section.

Application Example 5

In the above-described application example, the transport switching means transports the recycled paper sheet to the printing section by switching the transport section to one of the plurality of recycled paper sheet storage sections in which the recycled paper sheet is stored as the first recycled paper sheet storage section, when the recycled paper sheet stored in the first recycled paper sheet storage section runs out.

According to the above-described application example, when a new first recycled paper sheet storage section is selected from the recycled paper sheet storage sections except for the second recycled paper sheet storage section to which the recycled paper sheet is supplied from the paper sheet recycling section, and the recycled paper sheet is taken out from the first recycled paper sheet storage section, there is no case where the recycled paper sheet is inadvertently supplied from the paper sheet recycling section. In other words, it is possible to avoid the occurrence of jamming caused by the paper sheet complication in the first recycled paper sheet storage section.

Application Example 6

According to another application example, there is provided a printing apparatus including: a printing section which prints recording information on a recording target medium including a recycled paper sheet; a plurality of recycled paper sheet storage sections including a first recycled paper sheet storage section and a second recycled paper sheet storage section in which the recycled paper sheet supplied from a paper sheet recycling apparatus is stored; and a transport section which transports the recording target medium to the printing section, in which the transport section transports the recycled paper sheet from the first recycled paper sheet storage section to the printing section.

The printing apparatus of this application example can configure the paper sheet recycling and printing system with the paper sheet recycling apparatus that can form and supply the recycled paper sheet that serves as the recording target medium. In addition, according to the printing apparatus of this application example, the plurality of recycled paper sheet storage sections in which the recycled paper sheet formed by the paper sheet recycling apparatus can be stored, are provided. Accordingly, it becomes possible to store many recycled paper sheets, and it is possible to lengthen the continuous operation time of the paper sheet recycling apparatus, and to provide a recycled paper sheet having a stable quality.

In addition, according to the printing apparatus of this application example, from the plurality of recycled paper sheet storage sections in which the recycled paper sheet is stored, one recycled paper sheet storage section selected by supplying the recycled paper sheet to the printing section is designated as the first recycled paper sheet storage section, and one recycled paper sheet storage section selected by storing the recycled paper sheet formed and supplied from the paper sheet recycling apparatus is designated as the second recycled paper sheet storage section. Accordingly, by designating the first recycled paper sheet storage section and the second recycled paper sheet storage section as recycled paper sheet storage sections different from each other from the plurality of recycled paper sheet storage sections, when taking out the recycled paper sheet from the first recycled paper sheet storage section, the recycled paper sheet is not supplied inadvertently from the paper sheet recycling apparatus. In other words, it is possible to avoid occurrence of jamming caused by the paper sheet complication in the first recycled paper sheet storage section.

Application Example 7

In the above-described application example, the recycled paper sheet is not supplied from the paper sheet recycling apparatus to the first recycled paper sheet storage section.

According to the above-described application example, when taking out the recycled paper sheet from the first recycled paper sheet storage section, there is no case where the recycled paper sheet is inadvertently supplied from the paper sheet recycling apparatus. In other words, it is possible to avoid the occurrence of jamming caused by the paper sheet complication in the first recycled paper sheet storage section.

Application Example 8

In the above-described application example, the transport section includes transport switching means for transporting the recycled paper sheet to the printing section by switching the transport section to one of the plurality of recycled paper sheet storage sections in which the recycled paper sheet is stored as the first recycled paper sheet storage section, when the recycled paper sheet stored in the first recycled paper sheet storage section runs out.

According to the above-described application example, when a new first recycled paper sheet storage section is selected from the recycled paper sheet storage sections except for the second recycled paper sheet storage section to which the recycled paper sheet is supplied from the paper sheet recycling apparatus, and the recycled paper sheet is taken out from the first recycled paper sheet storage section, there is no case where the recycled paper sheet is inadvertently supplied from the paper sheet recycling apparatus. In other words, it is possible to avoid the occurrence of jamming caused by the paper sheet complication in the first recycled paper sheet storage section.

Application Example 9

According to still another application example, there is provided a paper sheet recycling apparatus including: a paper sheet recycling section which manufactures a recycled paper sheet; a plurality of recycled paper sheet storage sections including a first recycled paper sheet storage section and a second recycled paper sheet storage section in which the recycled paper sheet is stored; and a recycled paper sheet supply section which supplies the recycled paper sheet from the paper sheet recycling section to the recycled paper sheet storage section, in which the recycled paper sheet is transported from the first recycled paper sheet storage section to the printing apparatus, and in which the recycled paper sheet supply section supplies the recycled paper sheet to the second recycled paper sheet storage section.

The paper sheet recycling apparatus of this application example can configure the paper sheet recycling and printing system by the printing apparatus which prints the recording information on the recycled paper sheet to be supplied which is formed and supplied as the recording target medium. In addition, according to the paper sheet recycling apparatus of this application example, the plurality of recycled paper sheet storage sections which are provided in the paper sheet recycling apparatus and in which the recycled paper sheet can be stored, are provided. Accordingly, it becomes possible to store many recycled paper sheets, and it is possible to lengthen the continuous operation time of the paper sheet recycling apparatus, and to provide a recycled paper sheet having a stable quality.

In addition, according to the paper sheet recycling apparatus of this application example, from the plurality of recycled paper sheet storage sections in which the recycled paper sheet is stored, one recycled paper sheet storage section selected by supplying the recycled paper sheet to the printing apparatus is designated as the first recycled paper sheet storage section, and one recycled paper sheet storage section selected by storing the recycled paper sheet formed and supplied from the paper sheet recycling apparatus is designated as the second recycled paper sheet storage section. Accordingly, by designating the first recycled paper sheet storage section and the second recycled paper sheet storage section as recycled paper sheet storage sections different from each other from the plurality of recycled paper sheet storage sections, when taking out the recycled paper sheet from the first recycled paper sheet storage section, the recycled paper sheet is not supplied inadvertently from the paper sheet recycling section. In other words, it is possible to avoid the occurrence of jamming caused by the paper sheet complication in the first recycled paper sheet storage section.

Application Example 10

In the above-described application example, the recycled paper sheet supply section includes supply switching means that is capable of transporting the recycled paper sheet to one of the plurality of recycled paper sheet storage sections.

According to the above-described application example, it is possible to select one recycled paper sheet storage section in which the recycled paper sheet can be stored among the plurality of recycled paper sheet storage sections, and to supply the recycled paper sheet to the recycled paper sheet storage section selected by the supply switching means of the recycled paper sheet supply section and to store the recycled paper sheet therein. In other words, it is possible to supply the recycled paper sheet from the plurality of recycled paper sheet storage sections in which the recycled paper sheet formed by the paper sheet recycling section is stored to the recycled paper sheet storage section selected by the switching means of the recycled paper sheet supply section. Accordingly, it becomes possible to supply the recycled paper sheet to the selected recycled paper sheet storage section without stopping the paper sheet recycling section, and it is possible to lengthen the continuous operation time of the paper sheet recycling section, and to provide a recycled paper sheet having a stable quality.

Application Example 11

In the above-described application example, the supply switching means supplies the recycled paper sheet by switching the recycled paper sheet supply section to one recycled paper sheet storage section in which there is no recycled paper sheet among the plurality of recycled paper sheet storage sections as the second recycled paper sheet storage section.

According to the above-described application example, when a new second recycled paper sheet storage section is selected from the recycled paper sheet storage sections except for the first recycled paper sheet storage section which supplies the recycled paper sheet to the printing apparatus, and the recycled paper sheet is taken out from the first recycled paper sheet storage section, there is no case where the recycled paper sheet is inadvertently supplied from the paper sheet recycling section. In other words, it is possible to avoid occurrence of jamming caused by the paper sheet complication in the first recycled paper sheet storage section.

DESCRIPTION OF EMBODIMENTS

Hereinafter, embodiments of the present invention will be described with reference to the drawings.

First Embodiment

Figure 1:
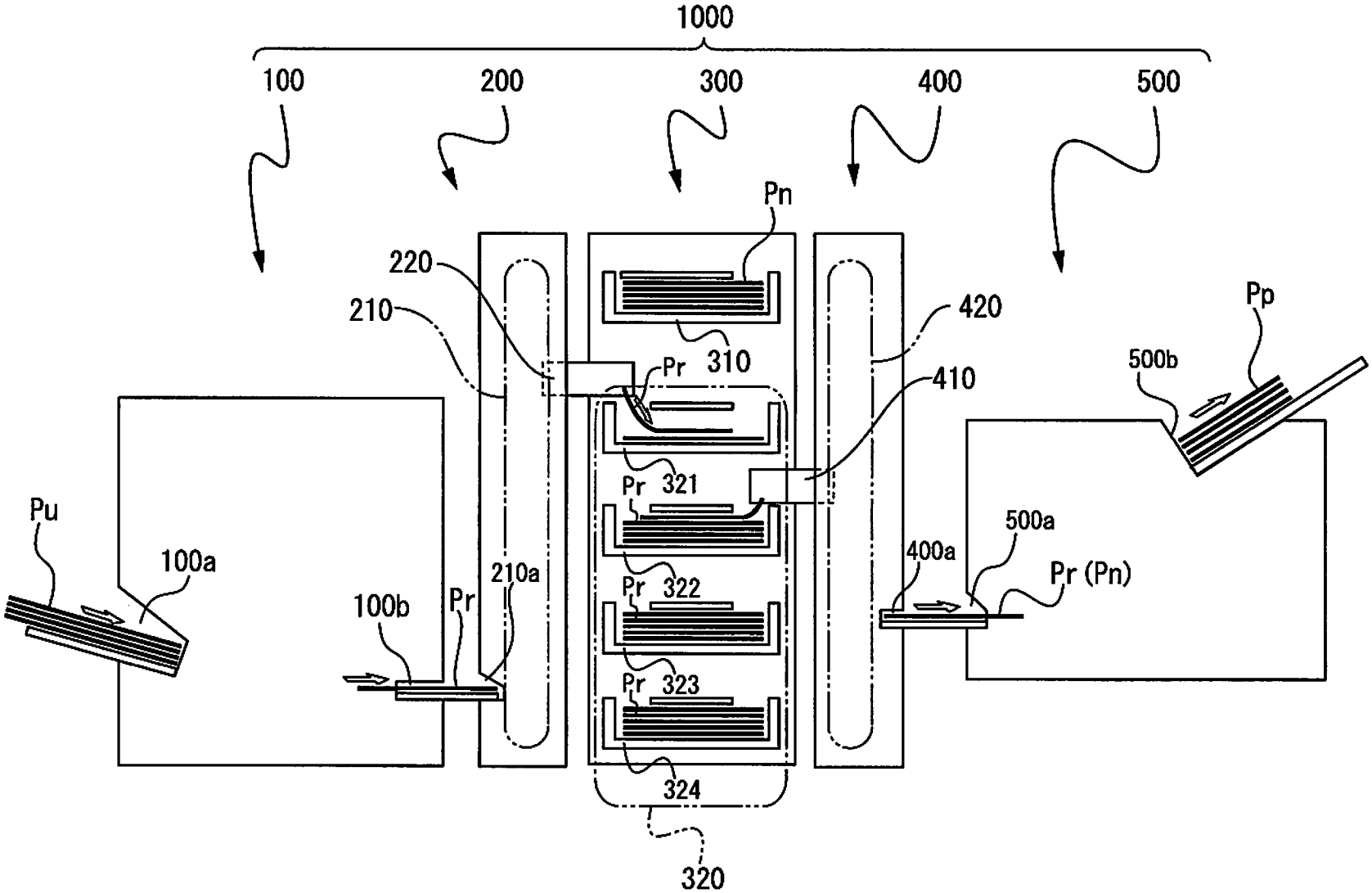
FIG. 1 is a configuration view illustrating a schematic configuration of a paper sheet recycling and printing apparatus according to a first embodiment.

FIG. 1 is a configuration view illustrating a schematic configuration of a paper sheet recycling and printing apparatus according to a first embodiment. A paper sheet recycling and printing apparatus 1000 illustrated in FIG. 1 includes a paper sheet recycling section 100, a storage section 300 in which a recycled paper sheet Pr recycled from a waste paper sheet Pu inserted into the paper sheet recycling section 100, and a new paper sheet Pn which has not been used for printing as a recording target medium, are stored, a printing section 500 which prints predetermined recording information on the new paper sheet Pn or the recycled paper sheet Pr supplied from the storage section 300, and an apparatus control section (not illustrated).

The storage section 300 includes a paper sheet storage section 310 in which the new paper sheet Pn is stored, and a recycled paper sheet storage unit 320 in which the recycled paper sheet Pr is stored. In this example, the recycled paper sheet storage unit 320 includes the plurality of recycled paper sheet storage sections 321, 322, 323, and 324 including the recycled paper sheet storage section 321 to which the recycled paper sheet Pr formed in the paper sheet recycling section 100 is supplied and in which the recycled paper sheet Pr is stored; the recycled paper sheet storage section 322 in which the recycled paper sheet Pr supplied to the printing section 500 is stored; and the recycled paper sheet storage sections 323 and 324 which stand by in a state where the recycled paper sheet Pr is stored, as illustrated in the drawing.

In addition, in the paper sheet recycling and printing apparatus 1000 illustrated in FIG. 1, one paper sheet storage section 310 in which the new paper sheet Pn is stored and four recycled paper sheet storage sections 321, 322, 323, and 324 in which the recycled paper sheet Pr is stored are exemplified, but the invention is not limited thereto. The plurality of paper sheet storage sections 310 in which the new paper sheet Pn is stored may be provided. The recycled paper sheet storage section in which the recycled paper sheet Pr is stored may include two recycled paper sheet storage sections including at least the recycled paper sheet storage section which supplies the recycled paper sheet to the printing section 500 and the recycled paper sheet storage section in which the recycled paper sheet Pr to be discharged from the paper sheet recycling section 100 is stored.

A recycled paper sheet supply section 200 is provided between the paper sheet recycling section 100 and the storage section 300. The recycled paper sheet supply section 200 is provided with recycled paper sheet transport means 210 (not illustrated in detail) and recycled paper sheet supply means 220. The waste paper sheet Pu is inserted into the paper sheet recycling section 100 from a waste paper sheet supply section 100*a* provided in the paper sheet recycling section 100, and the recycled paper sheet Pr which has been recycled is delivered to a recycled paper sheet insertion port 210*a* provided in the recycled paper sheet supply section 200 from a recycled paper sheet discharge section 100*b*.

The recycled paper sheet Pr inserted into the recycled paper sheet insertion port 210*a* is transported to the recycled paper sheet supply means 220 by the recycled paper sheet transport means 210. The recycled paper sheet supply means 220 moves such that the recycled paper sheet Pr can be supplied to any of the recycled paper sheet storage sections 321, 322, 323, and 324 provided in the recycled paper sheet storage unit 320 by driving means that serves as the supply switching means (not illustrated), and stores the recycled paper sheet Pr therein. In the present embodiment, an aspect in which the recycled paper sheet Pr is stored in the recycled paper sheet storage section 321 is illustrated.

Between the storage section 300 and the printing section 500, the transport section 400 for transporting and supplying the new paper sheet Pn or the recycled paper sheet Pr that is stored in the storage section 300 and serve as the recording target medium to the printing section 500, is provided.

The transport section 400 includes: paper sheet acquiring means 410 for picking up the desired paper sheet from the paper sheet storage section 310 in which the new paper sheet Pn is stored or the recycled paper sheet storage sections 321, 322, 323, and 324 in which the recycled paper sheet Pr is stored; and the paper sheet transport means 420 (not illustrated in detail) for transporting the paper sheet picked up by the paper sheet acquiring means 410 to a paper sheet supply section 400*a*.

The paper sheet acquiring means 410 is driven by the driving means that serves as the transport switching means (not illustrated) at the position at which the paper sheet storage section 310 in which the new paper sheet Pn is stored or the recycled paper sheet storage sections 321, 322, 323, and 324 in which the recycled paper sheet Pr is stored are disposed by a paper sheet selection command from the printing section 500, and can pick up a desired paper sheet.

The recycled paper sheet Pr supplied from the paper sheet supply section 400*a* of the transport section 400 or the new paper sheet Pn is taken into the apparatus from a paper sheet taking-in section 500*a* of the printing section 500, and is discharged to a printed material discharge section 500*b* as a printed material Pp on which the desired recording information is printed. In addition, the printing section 500 is not particularly limited as long as the printing section 500 forms the printed material Pp by making toner or ink of the recording medium adhere to the surface of the recording target medium, such as a so-called laser printer or an ink jet printer.

Figure 2:
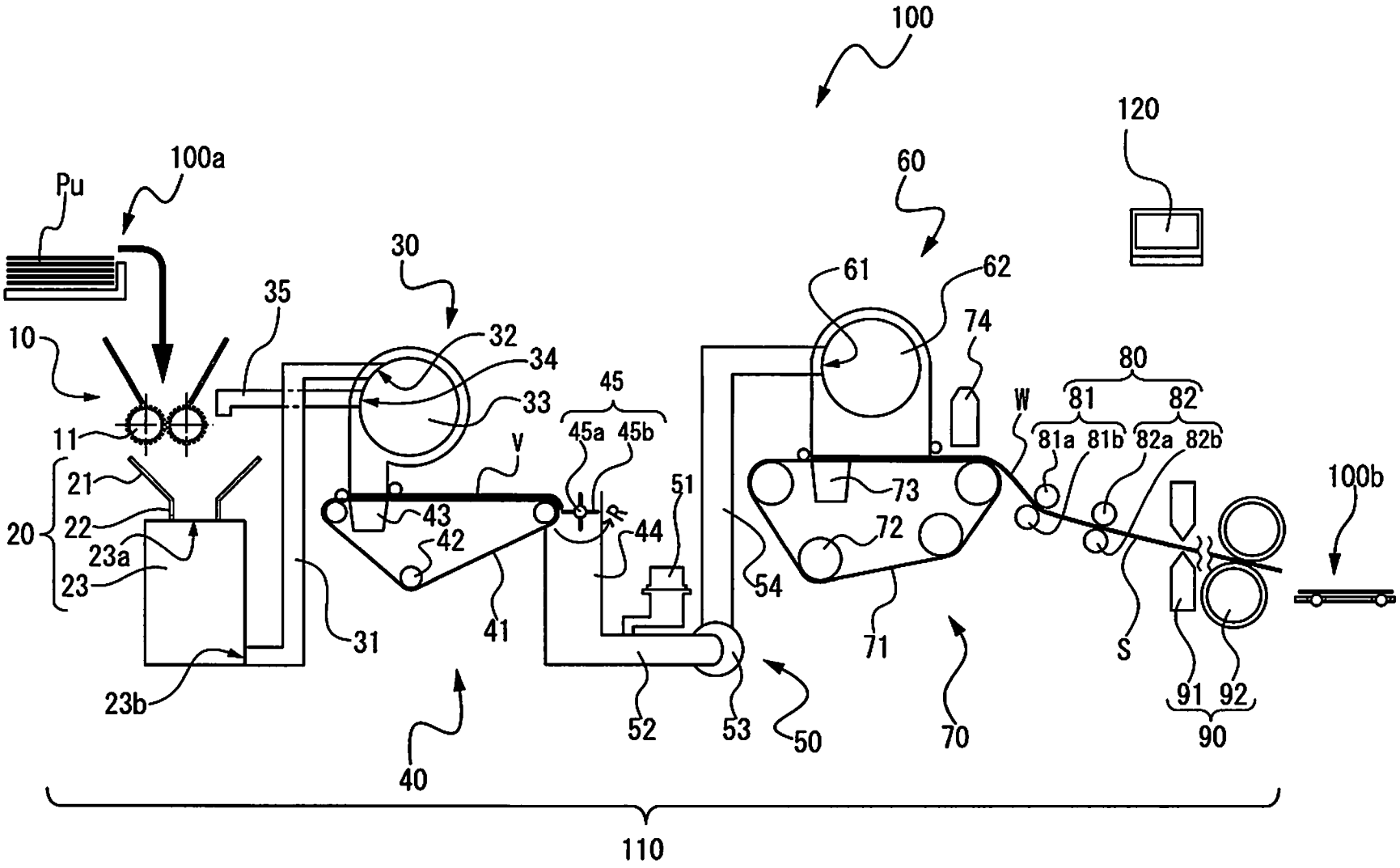
FIG. 2 is a configuration view illustrating a schematic configuration of a paper sheet recycling section included in the paper sheet recycling and printing apparatus according to the first embodiment.

FIG. 2 is a configuration view illustrating a schematic configuration of the paper sheet recycling section 100 included in the paper sheet recycling and printing apparatus 1000 according to the present embodiment. As illustrated in FIG. 2, the paper sheet recycling section 100 includes the waste paper sheet supply section 100*a*, a manufacturing section 110, and a control section 120. The manufacturing section 110 manufactures the recycled paper sheet Pr. The manufacturing section 110 includes a coarse crushing section 10, a defibrating section 20, a sorting section 30, a first web forming section 40, a rotating body 45, a mixing section 50, a depositing section 60, a second web forming section 70, a sheet forming section 80, and a cutting section 90.

The waste paper sheet supply section 100*a* supplies the waste paper sheet Pu to the coarse crushing section 10. The waste paper sheet supply section 100*a* is, for example, an automatic inserting section for continuously inserting the waste paper sheet Pu to the coarse crushing section 10. The waste paper sheet Pu supplied by the waste paper sheet supply section 100*a* is not limited to the waste paper sheet and may be any paper sheet containing fibers, for example, a pulp sheet.

In the coarse crushing section 10, the waste paper sheet Pu supplied by the waste paper sheet supply section 100*a* is cut into pieces by cutting in the air. The shape or size of the pieces is, for example, several cm square. In the example illustrated in the drawing, the coarse crushing section 10 has a coarse crushing blade 11, and the coarse crushing blade 11 can cut the inserted raw material. As the coarse crushing section 10, for example, a shredder can be used. The waste paper sheet Pu cut by the coarse crushing section 10 is transferred (transported) to a defibrating apparatus section 23 via a pipe 22 after being received by a hopper 21 provided in the defibrating section 20.

The defibrating apparatus section 23 defibrates the raw material cut by the coarse crushing section 10. Here, a term "defibrate" in the present specification means to disentangle the fibers of the waste paper sheet Pu that serves as a defibration target formed by binding a plurality of fibers, one by one. The defibrating apparatus section 23 also has a function of separating substances, such as resin particles, ink, toner, or bleed inhibitor, that adhere to the raw material, from the fibers.

The material that has passed through the defibrating apparatus section 23 is referred to as "defibrated material". There is also a case where "defibrated material" includes not only disentangled defibrated material fibers but also resin (resin for binding a plurality of fibers) particles separated from the fibers when disentangling the fibers, a coloring material, such as ink or toner, or additives, such as bleed inhibitor or paper strength enhancer.

The defibrating apparatus section 23 performs the defibration in a so-called dry type in the atmosphere (in the air) without using a solvent, water or the like. Specifically, as the defibrating apparatus section 23, an impeller mill is used. The defibrating apparatus section 23 has a function of generating an airflow that suctions the raw material and discharges the defibrated material. Accordingly, the defibrating apparatus section 23 can suction the raw material together with the airflow from an introduction port 23*a* by the airflow generated by the defibrating apparatus section 23 itself, perform defibration processing, and transport the defibrated material to a discharge port 23*b*. The defibrated material that has passed through the defibrating apparatus section 23 is transferred to the sorting section 30 via a pipe 31. In addition, the airflow for transporting the defibrated material from the defibrating apparatus section 23 to the sorting section 30 may use the airflow generated in the defibrating apparatus section 23, or may use the airflow by providing an airflow generating apparatus, such as a blower.

The sorting section 30 introduces the defibrated material defibrated by the defibrating section 20 through the pipe 31 into a sorting apparatus section 33 from the introduction port 32 and sorts the defibrated material according to the length of the fiber. For example, a sieve is used as the sorting apparatus section 33. The sorting apparatus section 33 has a mesh (filter, screen) and can divide the defibrated material into fibers or particles (fibers or particles that have passed through the mesh, that is, a first sorted material) smaller than an aperture of the mesh, and particles, undefibrated pieces, or dams (particles, pieces, or dams that do not pass through the mesh, that is, a second sorted material) larger than the aperture of the mesh. For example, the first sorted material is transferred to the mixing section 50 via a pipe 44. The second sorted material is returned from a discharge port 34 to the defibrating section 20 via a pipe 35. Specifically, the sorting apparatus section 33 is a cylindrical sieve which is rotationally driven by a motor. As the mesh of the sorting apparatus section 33, for example, a wire mesh, an expanded metal obtained by stretching a metal plate with a cut, and a punching metal having a hole formed in a metal plate by a press machine or the like are used.

The first web forming section 40 transports the first sorted material that has passed through the sorting section 30 to the mixing section 50. The first web forming section 40 includes a mesh belt 41, a stretching roller 42, and a suction section (suction mechanism) 43.

The suction section 43 can suction the first sorted material dispersed in the air passing through an opening (mesh opening) of the sorting section 30 onto the mesh belt 41. The first sorted material is suctioned from the sorting section 30 by the suction section 43, is deposited on the moving mesh belt 41, and forms a web V. The basic configuration of the mesh belt 41, the stretching roller 42, and the suction section 43 is the same as that of the mesh belt 71, a stretching roller 72, and a suction section (suction mechanism) 73 of the second web forming section 70 to be described later.

By passing through the sorting section 30 and the first web forming section 40, the web V is formed in a state of containing a large amount of air and being softly bulged. The web V deposited on the mesh belt 41 is inserted into the pipe 44 and transported to the mixing section 50.

The rotating body 45 can cut the web V before the web V is transported to the mixing section 50. In the illustrated example, the rotating body 45 has a base portion 45*a* and a protrusion portion 45*b* that protrudes from the base portion 45*a*. The protrusion portion 45*b* has, for example, a plate-like shape. In the illustrated example, four protrusion portions 45*b* are provided, and the four protrusion portions 45*b* are provided at equivalent intervals. As the base portion 45*a* rotates in a direction R, the protrusion portion 45*b* can rotate around the base portion 45*a*. By cutting the web V with the rotating body 45, for example, it is possible to reduce fluctuation in the amount of the defibrated material per unit time supplied to the depositing section 60 to be described later.

The mixing section 50 passes through the sorting section 30 and mixes the first sorted material transported by the first web forming section 40 and a binder resin powder with each other. The mixing section 50 includes a powder supply device 51 for supplying the binder resin powder, a pipe 52 for transporting the first sorted material and the binder resin powder, and a blower 53. The pipe 52 is continuous with the pipe 44.

In the mixing section 50, the airflow is generated by the blower 53, and the first sorted material and the binder resin powder supplied from the powder supply device 51 can be transported in the pipe 52 while being mixed with each other. The binder resin powder supplied from the powder supply device 51 contains a resin capable of binding a plurality of fibers. At the time when the resin is supplied, the plurality of fibers is not bound. The resin bonds the plurality of fibers by melting when passing through the sheet forming section 80 to be described later. In addition, the mechanism for mixing the first sorted material and the binder resin powder with each other is not particularly limited.

The binder resin powder supplied from the powder supply device 51 is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, and the like. These resins may be used alone or as an appropriate mixture thereof.

In addition, as the binder resin powder supplied from the powder supply device 51, in addition to the resin for binding the fibers, in accordance with the type of the sheet to be manufactured, a coloring agent for coloring the fibers, a coagulation preventing agent for preventing coagulation of fibers, a flame retardant for making fibers and the like unlikely to burn, and the like, may be included. The mixture of the first sorted material and the binder resin powder that has passed through the mixing section 50 is transferred to the depositing section 60 via a pipe 54.

The depositing section 60 introduces the mixture that has passed through the mixing section 50 from an introduction port 61 into a depositing apparatus section 62, disentangles the intertwined fibers of the defibrated material, and descends while dispersing in the air. Furthermore, in a case where the resin of the binder resin powder supplied from the powder supply device 51 is fibrous, the depositing apparatus section 62 disentangles the intertwined resin fibers. Accordingly, the depositing section 60 can deposit the mixture uniformly on the second web forming section 70.

As the depositing apparatus section 62, a cylindrical sieve having a rotating mesh is used, and allows fibers or particles smaller than the opening of the sieve of the mesh which are contained in the mixture that has passes through the mixing section 50, that is, fibers or particles that can pass through the mesh, pass therethrough. The configuration of the depositing section 60 is, for example, the same as the configuration of the sorting section 30.

In addition, the "sieve" of the depositing apparatus section 62 may not have a function of sorting a specific target. In other words, the "sieve" used as the depositing apparatus section 62 means that the mesh is provided, and may allow all of the mixtures introduced into the depositing apparatus section 62 pass therethrough.

The second web forming section 70 deposits the passing material that has passed through the depositing section 60 and forms a web W. The second web forming section 70 includes, for example, the mesh belt 71, the stretching roller 72, and the suction section (suction mechanism) 73.

While moving, the mesh belt 71 deposits the passing material that has passed through the opening (opening of the mesh) of the depositing section 60. The mesh belt 71 is configured to be stretched by the stretching roller 72, and to make the air pass therethrough while the passing material is unlikely to pass therethrough. The mesh belt 71 continuously moves as the stretching roller 72 rotates. As the passing material that has passed through the depositing section 60 descends and is accumulated on the continuously moving mesh belt 71, the web W is formed on the mesh belt 71.

The suction section 73 is provided below the mesh belt 71 (on a side opposite to the depositing section 60 side). The suction section 73 can generate a downwardly directed airflow (airflow from the depositing section 60 to the mesh belt 71). Accordingly, it is possible to increase a discharge speed of the passing material from the depositing section 60.

As described above, by passing through the depositing section 60 and the second web forming section 70 (web forming step), the web W is formed in a state of containing a large amount of air and being softly bulged. The web W deposited on the mesh belt 71 is transported to the sheet forming section 80. In addition, in the illustrated example, a humidity control section 74 which controls humidity of the web W is provided. In the humidity control section 74, water or water vapor can be added to the web W and the amount ratio between the web W and water can be adjusted.

The sheet forming section 80 pressurizes and heats the web W deposited on the mesh belt 71 and forms a sheet S. In the sheet forming section 80, a plurality of fibers in the mixture can be bound to each other via the binder resin powder by applying heat to the mixture of the defibrated material and the binder resin powder mixed in the web W.

The sheet forming section 80 includes the pressurizing section 81 for pressurizing the web W and the heating section 82 for heating the web W pressurized by the pressurizing section 81. The pressurizing section 81 is configured with the pair of calender rollers 81*a* and 81*b* and applies pressure to the web W. The thickness of the web W is reduced by being pressurized, and the density of the web W is increased. The heating section 82 includes the pair of heating rollers 82*a* and 82*b*. The sheet S is formed by heating the web W pressurized by the calender rollers 81*a* and 81*b* with the heating rollers 82*a* and 82*b* and binding the fibers by melting the resin. Here, the pressure applied to the web W by the calender rollers 81*a* and 81*b* of the pressurizing section 81 can be set higher than the pressure applied to the web W by the heating rollers 82*a* and 82*b* of the heating section 82. In addition, the number of the calender rollers 81*a* and 81*b* or the heating rollers 82*a* and 82*b* is not particularly limited.

The cutting section 90 cuts the sheet S formed by the sheet forming section 80. In the illustrated example, the cutting section 90 includes a first cutting section 91 for cutting the sheet S in a direction intersecting the transport direction of the sheet S, and a second cutting section 92 for cutting the sheet S in a direction parallel to the transport direction, for example, a roller cutter. For example, the second cutting section 92 cuts the sheet S that has passed through the first cutting section 91. By passing through the cutting section 90, the recycled paper sheet Pr of a cut form having a predetermined size cut from the sheet S is formed. The cut recycled paper sheet Pr of the cut form is discharged to the recycled paper sheet discharge section 100*b* illustrated in FIG. 1 and is transported to the recycled paper sheet supply section 200. In addition, the method of recycling the paper sheet is not limited to the above-described method, a method of physically removing the recording medium called a toner that adheres to the surface of the recording target medium may be adopted.

The recycled paper sheet Pr formed by the above-mentioned paper sheet recycling section 100 is supplied to any of the recycled paper sheet storage sections 321, 322, 323, and 324 provided in the recycled paper sheet storage unit 320 by the recycled paper sheet supply section 200 and is stored therein, as described in FIG. 1. In addition, the printing section 500 selects the recycled paper sheet Pr as the recording target medium, the recycled paper sheet Pr is taken out by the transport section 400 from any of the recycled paper sheet storage sections 321, 322, 323, and 324, and a predetermined quantity of recycled paper sheets Pr is transported to the printing section 500.

In this manner, from the plurality of recycled paper sheet storage sections 321, 322, 323, and 324, one recycled paper sheet storage section to which the recycled paper sheet Pr is supplied by the recycled paper sheet supply section 200 and one recycled paper sheet storage section from which the recycled paper sheet Pr is taken out by the transport section 400, are selected.

In addition, in the following description, one recycled paper sheet storage section which is selected from the plurality of recycled paper sheet storage sections 321, 322, 323, and 324 and to which the recycled paper sheet Pr is supplied by the recycled paper sheet supply section 200 is referred to as a second recycled paper sheet storage section 32B. Meanwhile, one recycled paper sheet storage section which is selected from the plurality of recycled paper sheet storage sections 321, 322, 323, and 324 and from which the recycled paper sheet Pr is taken out by the transport section 400 is referred to as a first recycled paper sheet storage section 32A.

Figure 3:
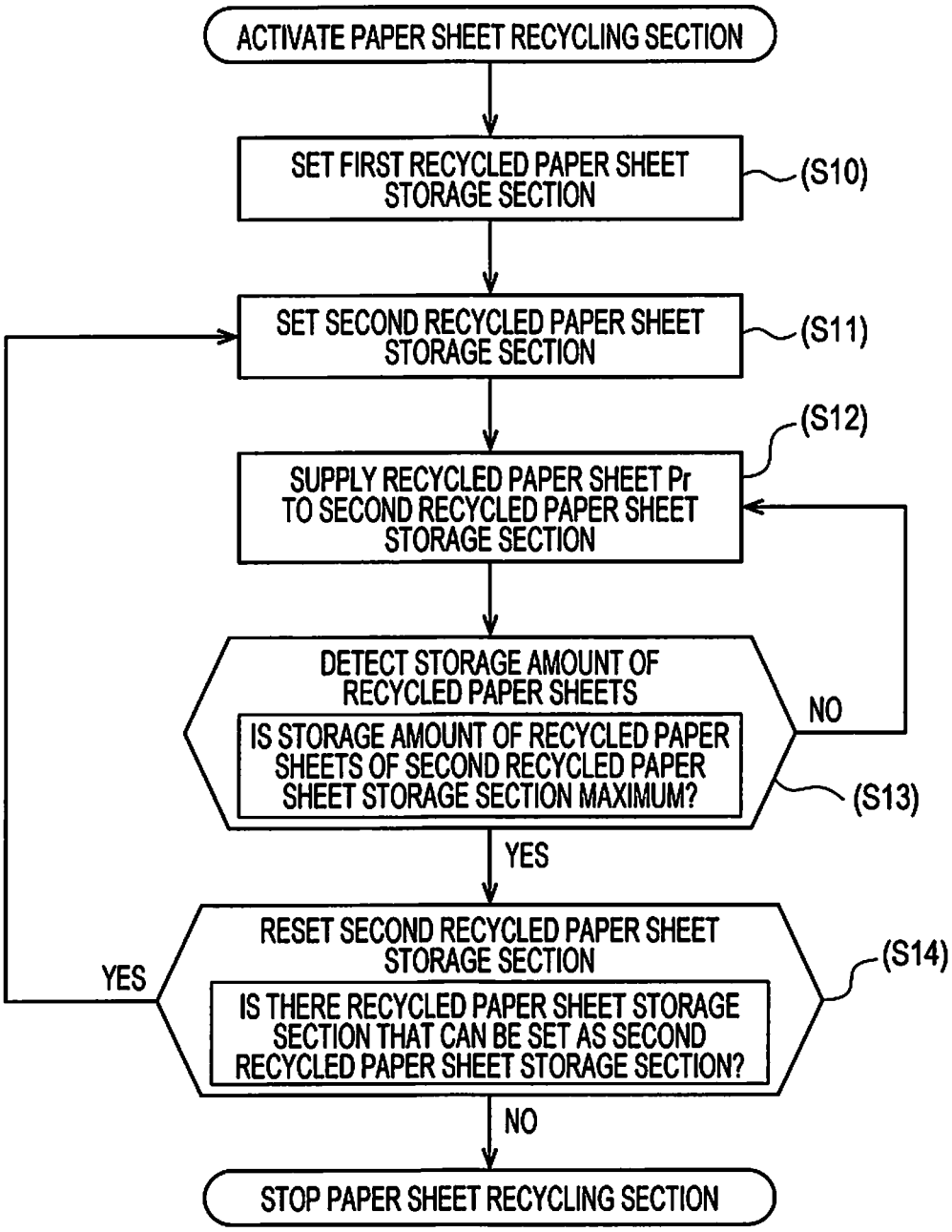
FIG. 3 is a flowchart illustrating a flow in which the recycled paper sheet is supplied from the paper sheet recycling section to a recycled paper sheet storage section in the paper sheet recycling and printing apparatus according to the first embodiment.

FIG. 3 is a flowchart illustrating a flow for supplying the recycled paper sheet Pr formed in the paper sheet recycling section 100 to the recycled paper sheet storage unit 320 provided in the storage section 300.

(Setting of First Recycled Paper Sheet Storage Section)

When the operation of the paper sheet recycling section 100 is started, firstly, the setting (S10) of the first recycled paper sheet storage section is executed. As described above, the first recycled paper sheet storage section 32A indicates one recycled paper sheet storage section which is selected from the plurality of recycled paper sheet storage sections 321, 322, 323, and 324 and from which the recycled paper sheet Pr is taken out by the transport section 400. In other words, among the recycled paper sheet storage sections 321, 322, 323, and 324, one recycled paper sheet storage sections in which the recycled paper sheet Pr can be transported to the printing section 500, is set in the first recycled paper sheet storage section 32A. In addition, when the operation of the paper sheet recycling section 100 is started, when the first recycled paper sheet storage section 32A has already been set, it is not necessary to reset the paper sheet storage section.

In the paper sheet recycling and printing apparatus 1000 according to the present embodiment illustrated in FIG. 1, an aspect in which the recycled paper sheet Pr transported from the recycled paper sheet storage section 322 provided in the recycled paper sheet storage unit 320 to the printing section 500 is taken out is exemplified. In this example, the apparatus control section (not illustrated) recognizes that the recycled paper sheet storage section 322 is the first recycled paper sheet storage section 32A, mid the paper sheet acquiring means 410 is driven by the transport switching means at the position of the recycled paper sheet storage section 322.

(Setting of Second Recycled Paper Sheet Storage Section)

Next, the setting (S11) of the second recycled paper sheet storage section in which, among the recycled paper sheet storage sections 321, 323, and 324 except for the first recycled paper sheet storage section 32A (recycled paper sheet storage section 322), one recycled paper sheet storage section in which the recycled paper sheet Pr supplied from the recycled paper sheet recycling section 100 and supplied by the recycled paper sheet supply section 200 is stored is set as the second recycled paper sheet storage section 32B, is executed.

Among the recycled paper sheet storage sections 321, 323, and 324 except for the first recycled paper sheet storage section 32A (recycled paper sheet storage section 322), the recycled paper sheet storage section in which the recycled paper sheet Pr is not stored is selected as the second recycled paper sheet storage section 32B. In the present embodiment, the recycled paper sheet storage section 321 is set as the second recycled paper sheet storage section 32B and the recycled paper sheet Pr is supplied.

In addition, when setting the second recycled paper sheet storage section 32B, it is not necessary to select the printing recycled paper sheet storage section in which there is no recycled paper sheet Pr. For example, in a case where the recycled paper sheet storage section which has already reached the maximum storage amount of the recycled paper sheet Pr has been excluded from options, and further, there is no recycled paper sheet storage section in which there is no recycled paper sheet Pr, even when the recycled paper sheet Pr is stored, it is possible to select the recycled paper sheet storage section having a region in which the new recycled paper sheet Pr can be stored. In the paper sheet recycling and printing apparatus 1000 illustrated in the present embodiment, in order to supply the recycled paper sheet Pr to the printing recycled paper sheet storage section 321 as illustrated in FIG. 1, the apparatus control section (not illustrated) recognizes that the recycled paper sheet storage section 321 is the second recycled paper sheet storage section 32B, and the recycled paper sheet supply means 220 is driven by the supply switching means at the position of the recycled paper sheet storage section 321.

(Recycled Paper Sheet Supply)

When the second recycled paper sheet storage section is set (S11), the supply (S12) of the recycled paper sheet from the recycled paper sheet supply means 220 of the recycled paper sheet supply section 200 to the set second recycled paper sheet storage section 32B, is executed.

(Recycled Paper Sheet Storage Amount Detection)

When the recycled paper sheet Pr is supplied to the second recycled paper sheet storage section 32B, the recycled paper sheet storage among detection (S13) in the second recycled paper sheet storage section 32B is performed. In the recycled paper sheet storage amount detection (S13), in a case where the maximum storage amount is not satisfied, that is, NO, the recycled paper sheet supply (S12) is performed again. However, in a case where the maximum storage amount has been reached, that is, YES, the process shifts to the next resetting (S14) of the second recycled paper sheet storage section.

(Resetting of Second Recycled Paper Sheet Storage Section)

When the recycled paper sheet storage section 321 illustrated in FIG. 1 in the present embodiment, which was set as the second recycled paper sheet storage section 32B, has reached the maximum storage amount of the recycled paper sheets Pr, the resetting (S14) of the second recycled paper sheet storage section is performed. In other words, in the present embodiment, it is determined whether or not it is possible to set one recycled paper sheet storage section from the recycled paper sheet storage sections 323 and 324 except for the recycled paper sheet storage section 322 set as the first recycled paper sheet storage section 32A from which the recycled paper sheet Pr transported to the above-described printing section 500 is taken out, and the recycled paper sheet storage section 321 that has reached the maximum storage amount of the recycled paper sheets Pr as the second recycled paper sheet storage section 32B, as the second recycled paper sheet storage section 32B.

In a case where both or any one of the recycled paper sheet storage sections 323 and 324 have the region in which the recycled paper sheet Pr can be stored (YES), the process shifts to the setting (S11) of the second recycled paper sheet storage section, and the recycled paper sheet Pr is stored in the newly set second recycled paper sheet storage section 32B. However, in a case where there is no region in which the recycled paper sheet Pr can be stored, that is, in a case where the maximum storage amount has been reached (NO), in any of the recycled paper sheet storage sections 323 and 324, the paper sheet recycling section 100 is stopped, and the supply of the recycled paper sheet Pr is paused.

In addition, stopping of paper sheet recycling section 100 is not only stopping of the paper sheet recycling apparatus according to the above-described flow, but also stopping of the paper sheet recycling apparatus in the following cases. For example, in a case where the planned forming quantity of the recycled paper sheet Pr with respect to the paper sheet recycling section 100 is input into the control section in advance and the planned forming quantity has been reached, the paper sheet recycling apparatus is stopped. Otherwise, in a case where all of the waste paper sheets Pu that serve as the raw material supplied to the waste paper sheet supply section 100*a* is consumed, the paper sheet recycling section 100 is stopped or paused while the waste paper sheet Pu is supplied again.

As described above, since any of the plurality of recycled paper sheet storage sections 321, 322, 323, and 324 provided in the recycled paper sheet storage unit 320 is set as the second recycled paper sheet storage section 32B to which the recycled paper sheet Pr is supplied, even when the paper sheet recycling section 100 is continuously operated, the recycled paper sheet Pr formed by the paper sheet recycling section 100 is supplied to any of the recycled paper sheet storage sections 321, 322, 323, and 324, and can be stored therein.

In other words, in the paper sheet recycling section 100 provided in the paper sheet recycling and printing apparatus 1000 according to the present embodiment described with reference to FIG. 2, in order to obtain the recycled paper sheet Pr having more stable quality, the plurality of recycled paper sheet storage sections 321, 322, 323, and 324 are provided in the recycled paper sheet storage unit 320, and the continuous operation for a long period of time by the paper sheet recycling section 100 is possible.

In addition, from the plurality of recycled paper sheet storage sections 321, 322, 323, and 324, from the recycled paper sheet storage section except for the recycled paper sheet storage section (recycled paper sheet storage section 322 in the example of the present embodiment) set as the first recycled paper sheet storage section 32A, the second recycled paper sheet storage section 32B (recycled paper sheet storage section 321 in the example of the present embodiment) is set as the recycled paper sheet storage section to which the recycled paper sheet Pr is supplied and in which the recycled paper sheet Pr is stored, and accordingly, it is possible to prevent a case where the taking-out of the recycled paper sheet Pr transported to the printing section 500 and the supply of the recycled paper sheet Pr from the paper sheet recycling section 100 overlap each other, that is, a so-called paper sheet complication, and to prevent occurrence of jamming.

Figure 4:
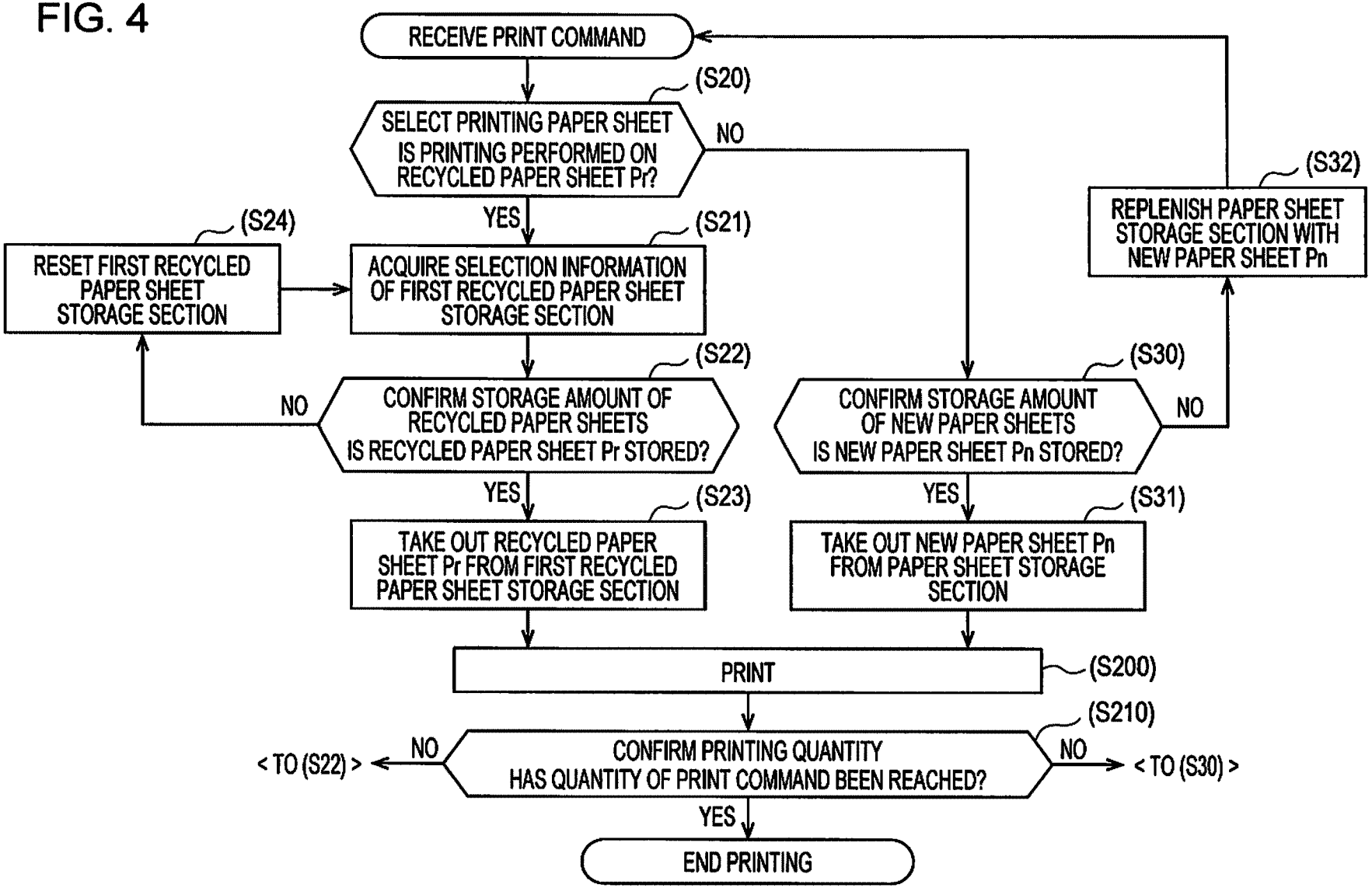
FIG. 4 is a flowchart illustrating a flow in which a recording target medium is supplied from the paper sheet storage section to a printing section in the paper sheet recycling and printing apparatus according to the first embodiment.

A flowchart of FIG. 4 illustrates a flow of transporting and supplying the new paper sheet Pn or the recycled paper sheet Pr stored in the storage section 300 to the printing section 500 and forming the printed material Pp.

(Printing Paper Sheet Selection)

As illustrated in FIG. 4, as the control section provided in the paper sheet recycling and printing apparatus 1000 receives the print command for starting the printing, the printing is started. First, the printing paper sheet selection (S20) for the printing is executed. In other words, the paper sheet recycling and printing apparatus 1000 according to the present embodiment is an apparatus that supplies the recycled paper sheet Pr recycled in the paper sheet recycling section 100 provided in the paper sheet recycling and printing apparatus 1000 together with the new paper sheet Pn as the recording target medium of the printing section 500 provided in the paper sheet recycling and printing apparatus 1000 and obtains the printed material Pp. Therefore, in the printing paper sheet selection (S20), it is determined and selected whether the printing paper sheet designated by the print command is the recycled paper sheet Pr or the new paper sheet Pn.

(Selection Information Acquisition of First Recycled Paper Sheet Storage Section)

When the recycled paper sheet Pr is selected (YES) in the printing paper sheet selection (S20), the selection information acquisition (S21) of the first recycled paper sheet storage section is executed, and the information on which one of the recycled paper sheet storage sections 321, 322, 323, and 324 is set as the first recycled paper sheet storage section 32A is acquired.

As described in FIG. 3, the first recycled paper sheet storage section 32A indicates one recycled paper sheet storage section which is selected from the plurality of printing recycled paper sheet storage sections 321, 322, 323, and 324 and from which the recycled paper sheet Pr is taken out by the transport section 400, in the recycled paper sheet storage unit 320. In other words, among the recycled paper sheet storage sections 321, 322, 323, and 324, one recycled paper sheet storage section in which the recycled paper sheet Pr can be transported to the printing section 500 is set as the first recycled paper sheet storage section 32A. In addition, in the paper sheet recycling and printing apparatus 1000 according to the present embodiment, an example in which the recycled paper sheet storage section 322 is set as the first recycled paper sheet storage section 32A (refer to FIG. 1).

(Recycled Paper Sheet Storage Amount Confirmation)

From the information acquired in the selection information acquisition (S21) of the first recycled paper sheet storage section, that is, the information indicating that the first recycled paper sheet storage section 32A is the recycled paper sheet storage section 322, the recycled paper sheet storage amount confirmation (S22) for confirming the presence or absence of the recycled paper sheet Pr of the recycled paper sheet storage section 322 is performed. When it is confirmed that at least one recycled paper sheet Pr is stored (YES), the process shifts to the next recycled paper sheet taking-out.

(Recycled Paper Sheet Taking-Out)

The recycled paper sheet taking-out (S23) in which the recycled paper sheet Pr is taken out from the first recycled paper sheet storage section 32A and is transported to the paper sheet taking-in section 500*a* of the printing section 500 by the transport section 400, is executed. In addition, the predetermined printing is executed (S200) by the printing section 500 with respect to the recycled paper sheet Pr transported to the paper sheet taking-in section 500*a*, and the recycled paper sheet Pr is discharged to the printed material discharge section 500*b* as the printed material Pp.

(Printing Quantity Confirmation)

When the printing is executed (S200), printing quantity confirmation (S210) for confirming whether or not the printing quantity commanded by the print command has been reached, is performed. Then, when it is confirmed that the predetermined quantity of the printed materials Pp is obtained, the printing is completed.

In the above-described recycled paper sheet storage amount confirmation (S22), in a case where it is confirmed that the recycled paper sheet Pr is not stored (NO) in the first recycled paper sheet storage section 32A in which the recycled paper sheet Pr is confirmed in the selection information acquisition (S21) of the first recycled paper sheet storage section in the previous step, the resetting (S24) of the first recycled paper sheet storage section 32A is performed.

(Resetting of First Recycled Paper Sheet Storage Section)

When it is confirmed that the recycled paper sheet Pr is not stored in the recycled paper sheet storage section 322 set in the first recycled paper sheet storage section 32A, the resetting (S24) of the first recycled paper sheet storage section is executed, and except for the recycled paper sheet storage section 321 set in the above-described second recycled paper sheet storage section 32B, any of the recycled paper sheet storage sections 323 and 324 provided in the recycled paper sheet storage unit 320 is set as the first recycled paper sheet storage section 32A again.

In addition, as described with reference to the above-described FIG. 3, the second recycled paper sheet storage section 32B is referred to as one selected recycled paper sheet storage section in which the recycled paper sheet Pr supplied from the paper sheet recycling section 100 and transported by the recycled paper sheet supply section 200 is stored among the recycled paper sheet storage sections 321, 323, and 324 except for the first recycled paper sheet storage section 32A (recycled paper sheet storage section 322).

Regarding which one of the recycled paper sheet storage sections 323 and 324 is to be set as the first recycled paper sheet storage section 32A, the invention is not particularly limited as long as the recycled paper sheet Pr is stored. For example, the recycled paper sheet storage section with a large storage amount of the recycled paper sheets Pr may be selected, or may be selected and instructed by the operator (person). In addition, although not illustrated, in a case where the recycled paper sheet Pr is not stored in all of the recycled paper sheet storage sections 321, 322, 323, and 324, the operator (person) is warned by the warning means (not illustrated), and the printing is completed.

When the new first recycled paper sheet storage section 32A is set by the resetting (S24) of the first recycled paper sheet storage section, the process shifts to the selection information acquisition (S21) of the first recycled paper sheet storage section, and the steps after the recycled paper sheet storage amount confirmation (S22) are executed.

Meanwhile, in a case where the recycled paper sheet Pr is not selected (NO) in the printing paper sheet selection (S20), the paper sheet storage section 310 in which the new paper sheet Pn is stored is selected. When the paper sheet storage section 310 is selected, the new paper sheet storage amount confirmation (S30) for confirming the presence or absence of the new paper sheet Pn stored in the paper sheet storage section 310, is performed. When it is confirmed (YES) that the new paper sheet Pn is stored in the new paper sheet storage amount confirmation (S30), the taking-out (S31) of the new paper sheet Pn from the paper sheet storage section 310 is performed, and the new paper sheet Pn is supplied to the printing section 500. Then, the printing (S200) and the printing quantity confirmation (S210) are executed.

Meanwhile, in a case where the new paper sheet Pn is not stored in the paper sheet storage section 310 (NO), the operator (person) is warned by warning means (not illustrated) and the paper sheet storage section 310 is replenished with the new paper sheet Pn (S32). In addition, when the paper sheet recycling and printing apparatus 1000 receives the command, such as a print restart command, the printing is restarted.

In addition, in the printing quantity confirmation (S210), in a case where the printing quantity based on the printing command has not been reached (NO), the process shifts to the recycled paper sheet storage amount confirming (S22) step in the flow of selecting the recycled paper sheet Pr as the printing paper sheet, and then the steps up to the next printing (S200) are executed. Similarly, in the flow in which the new paper sheet Pn is selected as the printed paper sheet, the process shifts to the new paper sheet storage amount confirming (S30) step, and then the steps up to the printing (S200) are executed.

Above, in the paper sheet recycling and printing apparatus 1000 according to the described present embodiment, as the plurality of recycled paper sheet storage sections 321, 322, 323, and 324 are provided in the recycled paper sheet storage unit 320 as illustrated in FIG. 1, even when there is no recycled paper sheet Pr from the first recycled paper sheet storage section 32A from which the recycled paper sheet Pr transported to the printing section 500 is taken out, one of the recycled paper sheet storage sections 321, 323, and 324 except for the first recycled paper sheet storage section 32A, that is, the recycled paper sheet storage section 322 in the example of the setting of the present embodiment, is reset (step S24) as the first recycled paper sheet storage section 32A again, and accordingly, it is possible to continue the printing without interruption.

Furthermore, when one of the recycled paper sheet storage sections 321, 323, and 324 except for the first recycled paper sheet storage section 32A, that is, the recycled paper sheet storage section 322 in the example of the setting of the present embodiment, is reset (step S24) as the first recycled paper sheet storage section 32A again, any of the recycled paper sheet storage sections 323 and 324 further except for the second recycled paper sheet storage section 32B to which the recycled paper sheet Pr formed in the paper sheet recycling section 100 is supplied and the recycled paper sheet storage section 321 in the example of the setting of the present embodiment, is reset as the second recycled paper sheet storage section 32B. Therefore, when the recycled paper sheet Pr transported from the first recycled paper sheet storage section 32A to the printing section 500 is taken out, there is no case where the supply of the recycled paper sheet Pr from the paper sheet recycling section 100 overlaps the taking-out. Therefore, it is possible to prevent occurrence of jamming at the time of paper feeding to the printing section 500.

Second Embodiment

Figure 5:
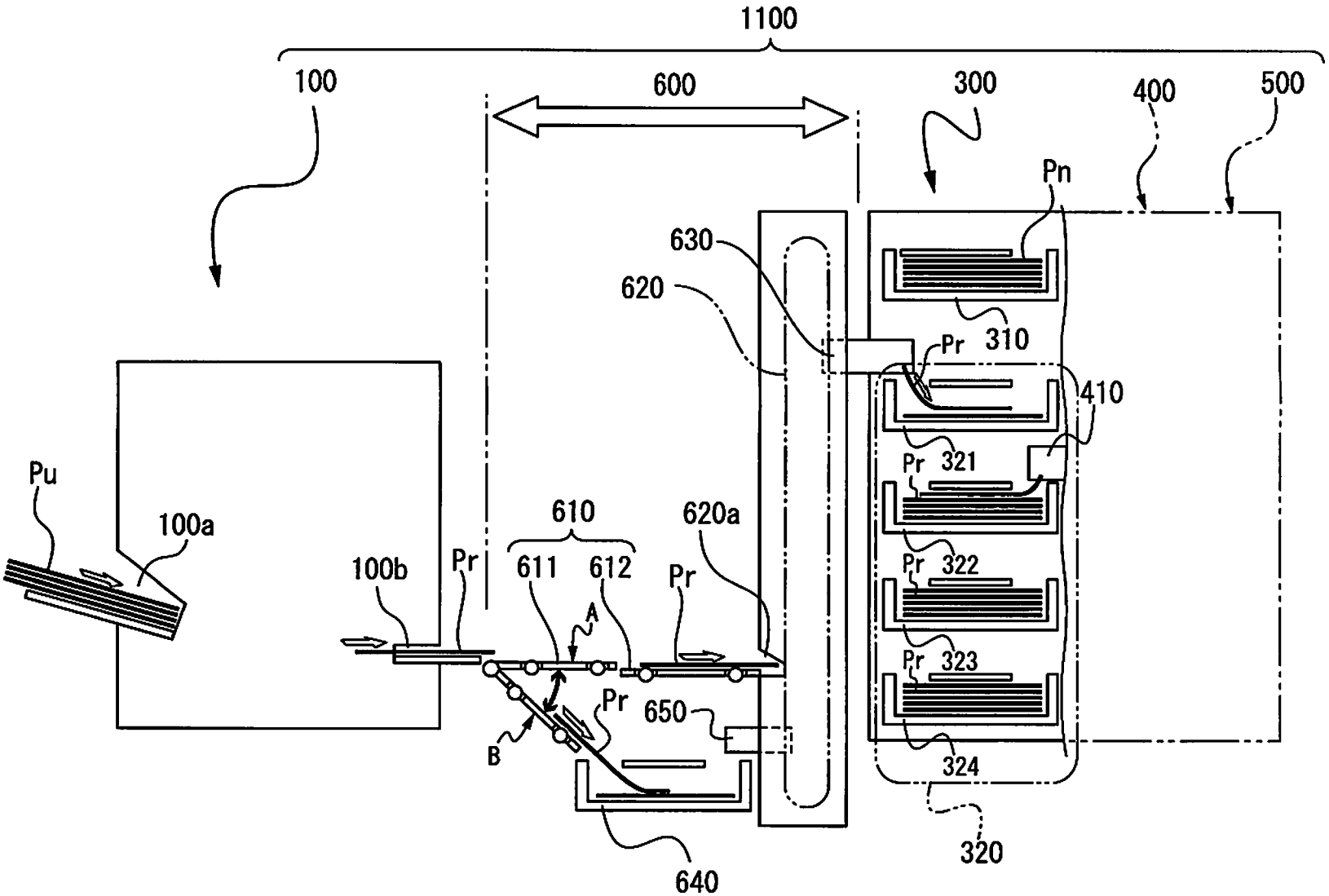
FIG. 5 is a configuration view illustrating a schematic configuration of a paper sheet recycling and printing apparatus according to a second embodiment.

FIG. 5 is a configuration view illustrating a schematic configuration of the paper sheet recycling and printing apparatus according to a second embodiment. The paper sheet recycling and printing apparatus 1100 illustrated in FIG. 5 is different from the paper sheet recycling and printing apparatus 1000 according to the first embodiment in the configuration of the recycled paper sheet supply section 200, and other configuration elements are the same as those of the paper sheet recycling and printing apparatus 1000. Accordingly, in the description of the paper sheet recycling and printing apparatus 1100 according to the second embodiment, the same reference numerals will be given to the same configuration elements as those of the paper sheet recycling and printing apparatus 1000 according to the first embodiment, and the description thereof will be omitted.

As illustrated in FIG. 5, the recycled paper sheet supply section 600 provided in the paper sheet recycling and printing apparatus 1100 includes recycled paper sheet transport means 620, and recycled paper sheet supply means 630 for transporting and supplying the recycled paper sheet Pr to any one predetermined recycled paper sheet storage section of the recycled paper sheet storage sections 321, 322, 323, and 324 by the driving means that serve as the supply switching means (not illustrated).

The recycled paper sheet Pr formed in the paper sheet recycling section 100 and discharged to the recycled paper sheet discharge section 100*b* is sent to a transport path 610 provided in the recycled paper sheet supply section 600. The transport path 610 is provided with a transport selection section 611 and a supply transport section 612 from the recycled paper sheet discharge section 100*b* side of the paper sheet recycling section 100. The supply transport section 612 is a path for transporting and supplying the recycled paper sheet Pr to the recycled paper sheet transport means 620. Meanwhile, the transport selection section 611 is provided with the driving means (not illustrated) which can be disposed at a position A or B illustrated in the drawing.

In a case where the transport selection section 611 is disposed at the position A, the recycled paper sheet Pr discharged from the recycled paper sheet discharge section 100*b* is sent to the supply transport section 612 and transported to the recycled paper sheet supply means 630 by the recycled paper sheet transport means 620. In addition, in a case where the transport selection section 611 is disposed at the position B, the recycled paper sheet Pr discharged from the recycled paper sheet discharge section 100*b* is transported and supplied to a recycled paper sheet preliminary storage section 640 provided in the recycled paper sheet supply section 600.

The recycled paper sheet supply section 600 includes a recycled paper sheet acquisition section 650. The recycled paper sheet acquisition section 650 takes out the recycled paper sheet Pr stored in the recycled paper sheet preliminary storage section 640 and supplies the recycled paper sheet Pr to the recycled paper sheet transport means 620. In addition, in the present embodiment, an aspect in which one recycled paper sheet preliminary storage section 640 is provided is exemplified, but the invention is not limited thereto, and a plurality of recycled paper sheet preliminary storage sections 640 may be provided.

Figure 6:
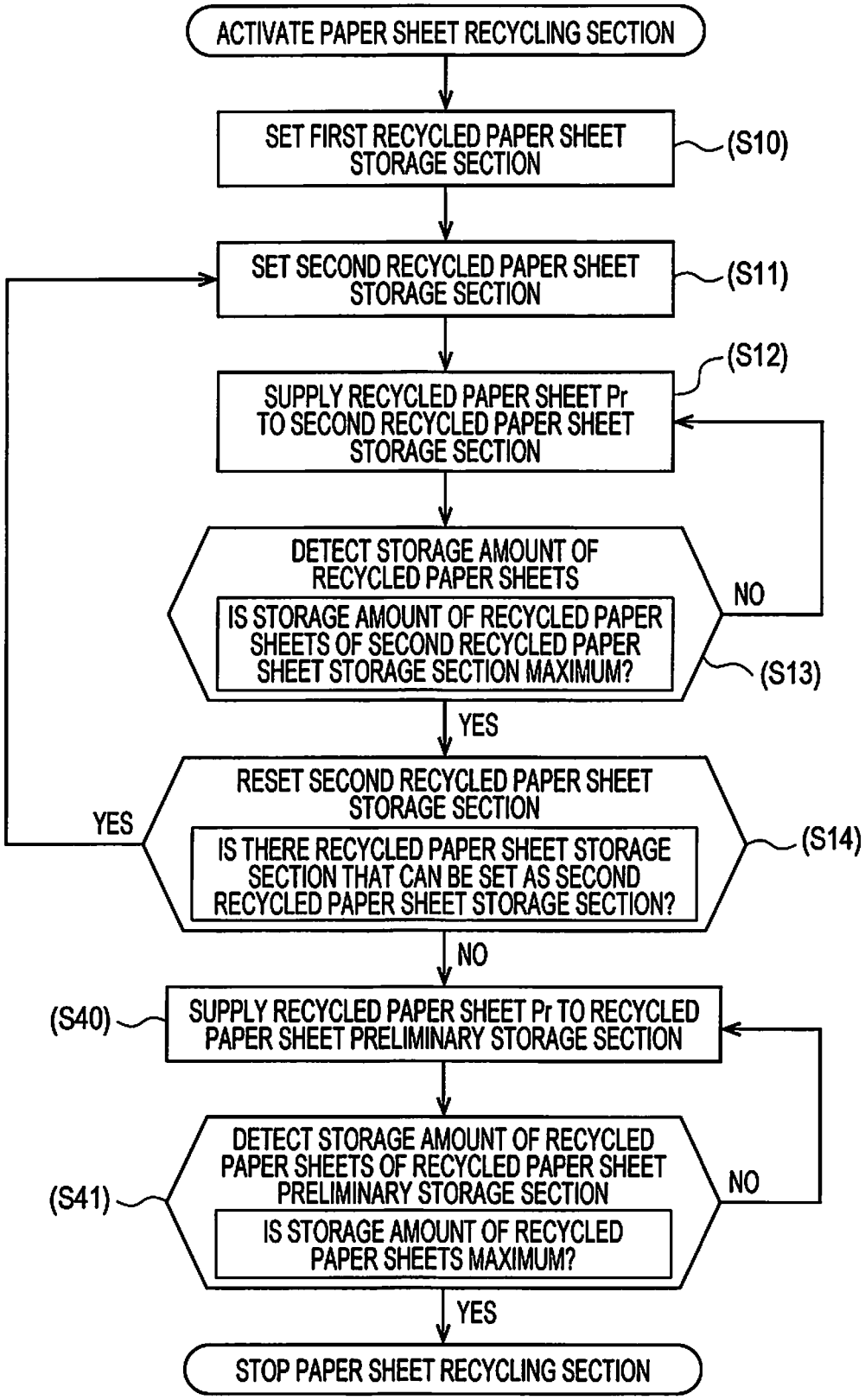
FIG. 6 is a flowchart illustrating a flow in which the recycled paper sheet is supplied from the paper sheet recycling section to a recycled paper sheet storage section in the paper sheet recycling and printing apparatus according to the second embodiment.

FIG. 6 is a flowchart describing to which one of the supply transport section 612 and the recycled paper sheet preliminary storage section 640 the recycled paper sheet Pr is transported by the transport selection section 611. Since the flowchart illustrated in FIG. 6 is the same up to the step of resetting (S14) the second recycled paper sheet storage section in the flowchart illustrated in FIG. 3, the same step numbers will be given to the same steps of the same flow, and the description thereof will be omitted.

As illustrated in FIG. 6, in the flow in which the recycled paper sheet Pr recycled by the paper sheet recycling section 100 in the paper sheet recycling and printing apparatus 1100 according to the present embodiment is stored in the storage section 300, when it is determined that there is no recycled paper sheet storage section that can be set as the second recycled paper sheet storage section 32B (NO) in the recycling setting (S14) of the second recycled paper sheet storage section, the transport selection section 611 illustrated in FIG. 5 is disposed at the position B and the recycled paper sheet Pr is supplied (S40) to the recycled paper sheet preliminary storage section 640 and stored therein.

In addition, when it is detected that the storage amount of the recycled paper sheet Pr has not reached the maximum (NO) in the next recycled paper sheet storage amount detection (S41) of the recycled paper sheet preliminary storage section 640, the recycled paper sheet Pr is continuously supplied to the recycled paper sheet preliminary storage section 640 and stored therein, and the maximum storage amount is reached (YES) in the recycled paper sheet storage amount detection (S41) of the recycled paper sheet preliminary storage section 640, the operation of the paper sheet recycling section 100 is stopped.

As described above, in the paper sheet recycling and printing apparatus 1100 according to the present embodiment, while the plurality of recycled paper sheet storage sections 321, 322, 323, and 324 are provided in this example in the recycled paper sheet storage unit, and a large amount of recycled paper sheets Pr can be stored, by providing the recycled paper sheet preliminary storage section 640, the paper sheet recycling section 100 can be operated continuously for a longer period of time. Therefore, the recycled paper sheet Pr having a more stable quality can be obtained.

Third Embodiment

As a third embodiment, a printing apparatus 2000 provided with the storage section 300 including the recycled paper sheet storage unit 320 will be described. In addition, the printing apparatus 2000 according to the present embodiment has an aspect in which the paper sheet recycling section 100 of the paper sheet recycling and printing apparatus 1000 according to the first embodiment is configured as a paper sheet recycling apparatus 2100 that serves as an independent apparatus and is incorporated in a paper sheet recycling and printing system 10000. Therefore, the same reference numerals will be given to the same configuration elements as those of the paper sheet recycling and printing apparatus 1000 according to the first embodiment, and the description thereof will be omitted.

More specifically, in the printing apparatus 2000 according to the present embodiment, the printing section 500, the transport section 400, the storage section 300, and the recycled paper sheet supply section 200 have the same reference numerals as those of the paper sheet recycling and printing apparatus 1000 according to the first embodiment.

Figure 7:
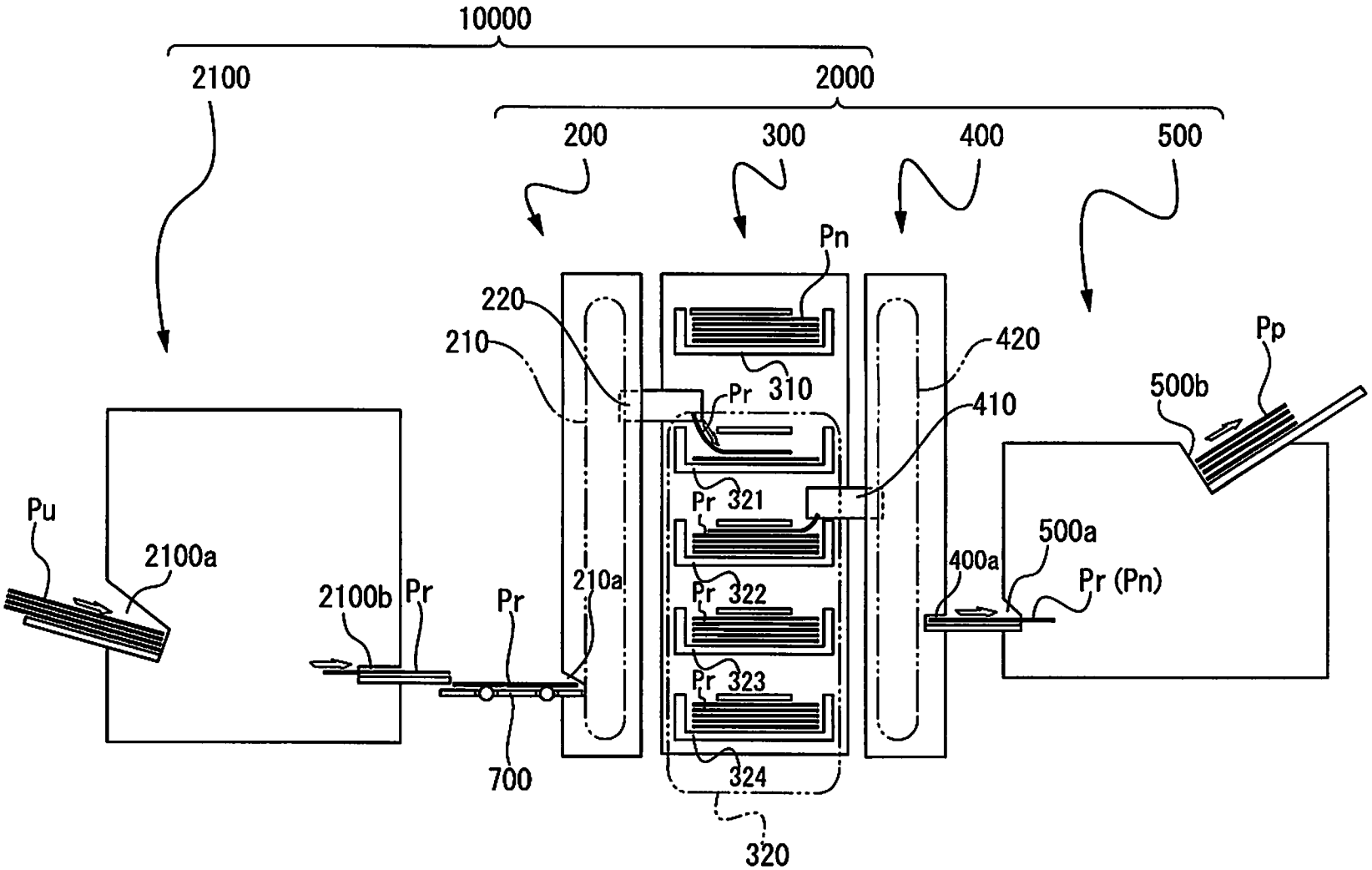
FIG. 7 is a configuration view illustrating a schematic configuration of a paper sheet recycling and printing system including a printing apparatus according to a third embodiment.

As illustrated in FIG. 7, the paper sheet recycling and printing system 10000 includes the paper sheet recycling apparatus 2100 and the printing apparatus 2000. The paper sheet recycling apparatus 2100 includes the same apparatus configuration (refer to FIG. 2) on the inside thereof as the paper sheet recycling section 100 provided in the paper sheet recycling and printing apparatus 1000 illustrated in FIG. 1, for example, and the waste paper sheet Pu supplied to a waste paper sheet supply section 2100*a* is discharged to a recycled paper sheet discharge section 2100*b* as the recycled paper sheet Pr.

The discharged recycled paper sheet Pr is transported to the recycled paper sheet insertion port 210*a* of the recycled paper sheet supply section 200 via the supply transport section 700. Then, the transported recycled paper sheet Pr is supplied from the recycled paper sheet supply section 200 to any of the recycled paper sheet storage sections 321, 322, 323, and 324 provided in the recycled paper sheet storage unit 320 and stored therein.

The supply transport section 700 is provided in the recycled paper sheet supply section 200, but is disposed to be detachable from the paper sheet recycling apparatus 2100. In this manner, as the paper sheet recycling apparatus 2100 and the printing apparatus 2000 are configured to be separable at the position of the supply transport section 700, it is possible to easily exchange only the paper sheet recycling apparatus 2100, and to easily perform maintenance and management of the paper sheet recycling and printing system 10000.

In addition, in the printing apparatus 2000 according to the present embodiment, since a flow for supplying the recycled paper sheet Pr supplied from the paper sheet recycling apparatus 2100 to the recycled paper sheet storage unit 320 is the same as the flowchart illustrated in FIG. 3, the description thereof will be omitted. In addition, since a flow for transporting and supplying the new paper sheet Pn or the recycled paper sheet Pr stored in the storage section 300 to the printing section 500 and forming the printed material Pp is the same as that of the flowchart illustrated in FIG. 4, the description thereof will be omitted.

Fourth Embodiment

As a fourth embodiment, a paper sheet recycling apparatus 3000 provided with the storage section 300 including the recycled paper sheet storage unit 320 will be described. In addition, the paper sheet recycling apparatus 3000 according to the present embodiment has an aspect in which the printing section 500 of the paper sheet recycling and printing apparatus 1000 according to the first embodiment is configured as a printing apparatus 3100 that serves as an independent apparatus and is incorporated in a paper sheet recycling and printing system 20000. Therefore, the same reference numerals will be given to the same configuration elements as those of the paper sheet recycling and printing apparatus 1000 according to the first embodiment, and the description thereof will be omitted.

More specifically, in the paper sheet recycling apparatus 3000 according to the present embodiment, the paper sheet recycling section 100, the recycled paper sheet supply section 200, the storage section 300, and the transport section 400, are the same configuration elements as those of the paper sheet recycling and printing apparatus 1000 according to the first embodiment.

Figure 8:
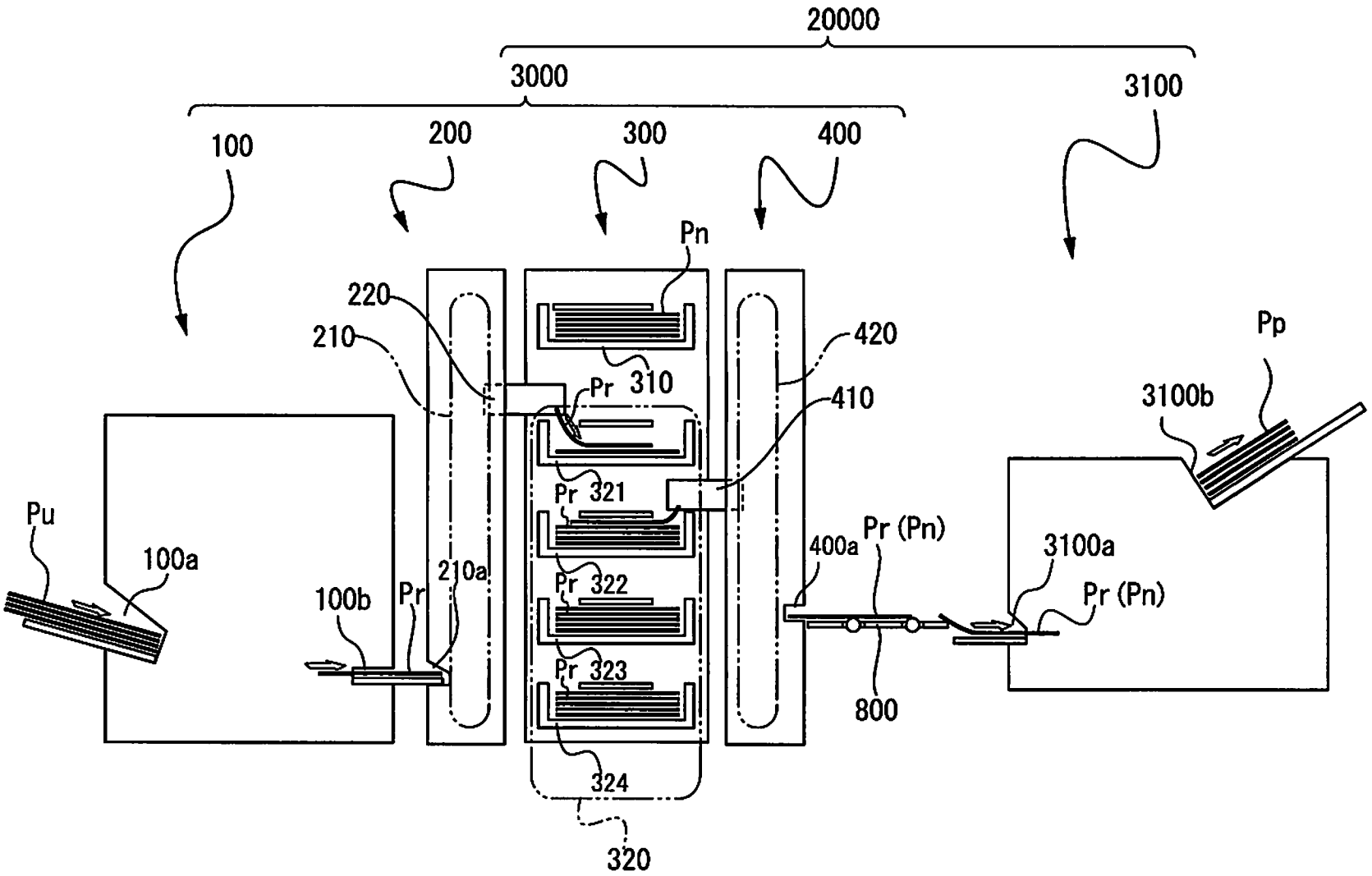
FIG. 8 is a configuration view illustrating a schematic configuration of a paper sheet recycling and printing system including a paper sheet recycling apparatus according to a fourth embodiment.

As illustrated in FIG. 8, the paper sheet recycling and printing system 20000 includes the paper sheet recycling apparatus 3000 and the printing apparatus 3100. The paper sheet recycling apparatus 3000 stores the recycled paper sheet Pr formed in the paper sheet recycling section 100 in any of the plurality of recycled paper sheet storage sections 321, 322, 323, and 324 of the recycled paper sheet storage unit 320 provided in the storage section 300, supplies the new paper sheet Pn that serves as the predetermined recording target medium from the paper sheet storage section 310 by the print command from the printing apparatus 3100, supplies the recycled paper sheet Pr from the recycled paper sheet storage unit 320 to the printing apparatus 3100 according to the flowchart illustrated in FIG. 4, and obtains the printed material Pp.

Between the transport section 400 and the printing apparatus 3100, the new paper sheet Pn or the recycled paper sheet Pr of the recording target medium discharged from the paper sheet supply section 400*a* is transported to the paper sheet taking-in section 3100*a* of the printing apparatus 3100 by the supply transport section 800 provided in the transport section 400.

The supply transport section 800 is disposed separably between the paper sheet recycling apparatus 3000 and the printing apparatus 3100, and can easily exchange the printing apparatus 3100. In other words, in the paper sheet recycling and printing system 20000, the printing apparatus 3100 is an apparatus that is easily applied to an appropriate printing apparatus according to work, for example, from a laser printer to an ink jet printer or a printing apparatus having a faster printing speed, or from a monochrome printer to a color printer.

In addition, in the paper sheet recycling apparatus 3000 according to the present embodiment, since a flow for supplying the recycled paper sheet Pr supplied from the paper sheet recycling section 100 to the recycled paper sheet storage unit 320 is the same as those of the flowchart illustrated in FIG. 3, the description thereof will be omitted. In addition, since a flow for transporting and supplying the new paper sheet Pn or the recycled paper sheet Pr stored in the storage section 300 to the printing apparatus 3100 and forming the printed material Pp is the same as that of the flowchart illustrated in FIG. 4, the description thereof will be omitted.

As described above, in the paper sheet recycling and printing apparatus 1000 according to the first embodiment, the paper sheet recycling and printing system 10000 including the printing apparatus 2000 according to the second embodiment, and the paper sheet recycling and printing system 20000 including the paper sheet recycling apparatus 3000 according to the third embodiment, as the plurality of recycled paper sheet storage sections 321, 322, 323, and 324 are provided in the recycled paper sheet storage unit 320 as illustrated in FIG. 1, even when there is no recycled paper sheet Pr from the first recycled paper sheet storage section 32A from which the recycled paper sheet Pr transported to the printing section 500 or the printing apparatus 3100 is taken out, as illustrated in the flowchart of FIG. 4, one of the recycled paper sheet storage sections 321, 323, and 324 except for the first recycled paper sheet storage section 32A, that is, the recycled paper sheet storage section 322 in the example of the setting of the above-described embodiment, is reset (step S24) as the first recycled paper sheet storage section 32A again, and accordingly, it is possible to continue the printing without interruption.

Furthermore, when one of the recycled paper sheet storage sections 321, 323, and 324 except for the first recycled paper sheet storage section 32A, that is, the recycled paper sheet storage section 322 in the example of the setting of the present embodiment, is reset (step S24) as the first recycled paper sheet storage section 32A again, any of the recycled paper sheet storage sections 323 and 324 further except for the second recycled paper sheet storage section 32B to which the recycled paper sheet Pr formed in the paper sheet recycling section 100 or the paper sheet recycling apparatus 2100 is supplied and the recycled paper sheet storage section 321 in the example of the setting of the above-described embodiment, is reset as the second recycled paper sheet storage section 32B. Therefore, when the recycled paper sheet Pr transported from the first recycled paper sheet storage section 32A to the printing section 500 or the printing apparatus 3100 is taken out, there is no case where the supply of the recycled paper sheet Pr from the paper sheet recycling section 100 or the paper sheet recycling apparatus 2100 overlaps the taking-out. Therefore, it is possible to prevent occurrence of jamming at the time of paper feeding to the printing section 500 or the printing apparatus 3100.

REFERENCE SIGNS LIST

100 paper sheet recycling section
200 recycled paper sheet supply section
300 storage section
400 transport section
500 printing section
1000 paper sheet recycling and printing apparatus

The invention claimed is:

1. A paper sheet recycling and printing apparatus comprising:

a paper sheet recycling section which manufactures a recycled paper sheet by recycling a waste paper sheet and includes at least a waste paper sheet supply port from which the waste paper sheet is supplied and a recycled paper sheet discharge port from which the recycled paper sheet that has been manufactured from the waste paper sheet is discharged;

a printer which prints recording information on a recording target medium including the recycled paper sheet;

a plurality of recycled paper sheet storage sections including a first recycled paper sheet storage section and a second recycled paper sheet storage section in which the recycled paper sheet that has been manufactured at the paper sheet recycling section is stored;

a recycled paper sheet supply section which supplies the recycled paper sheet that has been manufactured at the paper sheet recycling section from the paper sheet recycling section to the recycled paper sheet storage section, the recycled paper sheet supply section being disposed downstream relative to the paper sheet recycling section and upstream relative to the recycled paper sheet storage sections in a supply direction of the recycled paper sheet, the recycled paper sheet supply section including at least a recycled paper sheet insertion port from which the recycled paper sheet is inserted thereinto; and a transport section which transports the recording target medium to the printer, and includes at least a paper sheet supply port from which the recording target medium is supplied to the printer, wherein the transport section transports the recycled paper sheet stored in the first recycled paper sheet storage section to the printer, and wherein the recycled paper sheet supply section supplies the recycled paper sheet which has been manufactured at the paper sheet recycling section to the second recycled paper sheet storage section.

2. The paper sheet recycling and printing apparatus according to claim 1, wherein the recycled paper sheet supply section includes supply switching means that is capable of transporting the recycled paper sheet to one of the plurality of recycled paper sheet storage sections.

3. The paper sheet recycling and printing apparatus according to claim 2, wherein the supply switching means switches supply of the recycled paper sheet from the recycled paper sheet supply section to one recycled paper sheet storage section in which there is no recycled paper sheet among the plurality of recycled paper sheet storage sections as the second recycled paper sheet storage section.

4. The paper sheet recycling and printing apparatus according to claim 1, wherein the transport section includes transport switching means for setting one of the plurality of the recycled paper sheet storage sections as the first recycled paper sheet storage section and for transporting the recycled paper sheet from the set first recycled paper sheet storage section.

5. The paper sheet recycling and printing apparatus according to claim 4, wherein the transport switching means transports the recycled paper sheet to the printer by switching the transport section to one of the plurality of recycled paper sheet storage sections in which the recycled paper sheet is stored as the first recycled paper sheet storage section, when the recycled paper sheet stored in the first recycled paper sheet storage section runs out.

6. A printing apparatus comprising:

a printer which prints recording information on a recording target medium including a recycled paper sheet that has been manufactured by recycling a waste paper sheet at a paper sheet recycling apparatus;

a plurality of recycled paper sheet storage sections including a first recycled paper sheet storage section and a second recycled paper sheet storage section in which the recycled paper sheet that has been manufactured at the paper sheet recycling apparatus and is supplied from the paper sheet recycling apparatus is stored; and a transport section which transports the recording target medium to the printer, and includes at least a paper sheet supply port from which the recording target medium is supplied to the printer, wherein the transport section transports the recycled paper sheet from the first recycled paper sheet storage section to the printer.

7. The printing apparatus according to claim 6, wherein the recycled paper sheet is not supplied from the paper sheet recycling apparatus to the first recycled paper sheet storage section.

8. The printing apparatus according to claim 6, wherein the transport section includes transport switching means for transporting the recycled paper sheet to the printer by switching the transport section to one of the plurality of recycled paper sheet storage sections in which the recycled paper sheet is stored as the first recycled paper sheet storage section, when the recycled paper sheet stored in the first recycled paper sheet storage section runs out.

9. A paper sheet recycling apparatus comprising:

a paper sheet recycling section which manufactures a recycled paper sheet by recycling a waste paper sheet and includes at least a waste paper sheet supply port from which the waste paper sheet is supplied and a recycled paper sheet discharge port from which the recycled paper sheet that has been manufactured from the waste paper sheet is discharged;

a plurality of recycled paper sheet storage sections including a first recycled paper sheet storage section and a second recycled paper sheet storage section in which the recycled paper sheet that has been manufactured at the paper sheet recycling section is stored; and a recycled paper sheet supply section which supplies the recycled paper sheet that has been manufactured at the paper sheet recycling section from the paper sheet recycling section to the recycled paper sheet storage section, the recycled paper sheet supply section being disposed downstream relative to the paper sheet recycling section and upstream relative to the recycled paper sheet storage sections in a supply direction of the recycled paper sheet, the recycled paper sheet supply section including at least a recycled paper sheet insertion port from which the recycled paper sheet is inserted thereinto, wherein the recycled paper sheet is transported from the first recycled paper sheet storage section to a printing apparatus, and wherein the recycled paper sheet supply section supplies the recycled paper sheet to the second recycled paper sheet storage section.

10. The paper sheet recycling apparatus according to claim 9, wherein the recycled paper sheet supply section includes supply switching means that is capable of transporting the recycled paper sheet to one of the plurality of recycled paper sheet storage sections.

11. The paper sheet recycling apparatus according to claim 10, wherein the supply switching means supplies the recycled paper sheet by switching the recycled paper sheet supply section to one recycled paper sheet storage section in which there is no recycled paper sheet among the plurality of recycled paper sheet storage sections as the second recycled paper sheet storage section.

* * * * *